US005669173A

United States Patent [19]

Rodney, Jr.

[11] Patent Number: 5,669,173

[45] Date of Patent: Sep. 23, 1997

[54] SCOPE MOUNTING SYSTEM WITH RECOIL STOP

[76] Inventor: Frederick W. Rodney, Jr., 134 Flagg Rd., Gonic, N.H. 03839

[21] Appl. No.: 659,745

[22] Filed: Jun. 6, 1996

[51] Int. Cl.[6] ..... F41G 1/38

[52] U.S. Cl. ..... 42/101; 42/100; 42/102; 42/103

[58] Field of Search ..... 42/101, 100, 102, 42/103

[56] References Cited

U.S. PATENT DOCUMENTS

| | | | |
|---|---|---|---|
| 3,992,783 | 11/1976 | Dunlap et al. | 33/250 |
| 4,249,315 | 2/1981 | Hopson, III | 33/250 |
| 4,799,325 | 1/1989 | Booze | 42/100 |
| 4,841,659 | 6/1989 | Williams | 42/101 |
| 4,859,058 | 8/1989 | Ekstrand | 356/251 |
| 4,862,624 | 9/1989 | Williams | 42/101 |
| 5,033,219 | 7/1991 | Johnson et al. | 42/103 |
| 5,531,039 | 7/1996 | Gore | 42/101 |

*Primary Examiner*—Charles T. Jordan
*Assistant Examiner*—Meena Chelliah
*Attorney, Agent, or Firm*—Davis and Bujold

[57] ABSTRACT

A scope mounting system comprising a pair of scope ring assemblies, each having a clamp mechanism for clamping a desired scope thereto, and a pair of scope bases. Each scope ring assembling has a female dovetail slot for releasably mating with a male dovetail protrusion provided on a mating scope base. The scope base also including a mechanism for releasably attaching the scope base to the barrel of a desired firearm. The scope base includes a recoil stop for preventing forward axial sliding movement of the scope ring assembly relative to the scope base upon discharge of a firearm incorporating the present invention. Each scope ring assembly may also be provided with a mating recess for cooperating with and abutting against the recoil stop of the scope base.

20 Claims, 3 Drawing Sheets

SCOPE MOUNTING SYSTEM WITH RECOIL STOP

The present invention relates to an improvement concerning a scope mounting system for a firearm and, in particular, a system which facilitates automatic zeroing of the scope upon each discharge of the firearm.

BACKGROUND OF THE INVENTION

Presently, there are a variety of known mounting systems for mounting a scope to a firearm. In all of the currently available systems, the scope has a tendency to move or slide slightly axially forward, relative to the longitudinal length of the barrel of the firearm, upon discharge of the firearm thereby changing the zeroed position of the scope relative to the firearm. After repeated discharge of the firearm, the scope may have moved enough, relative to the barrel of the firearm, to decrease significantly the accuracy of the firearm thereby requiring the firearm to be again sighted. The resighting procedure is usually time consuming, can be annoying to the user of the firearm, and is generally to be avoided.

SUMMARY OF THE INVENTION

Wherefore, it is an object of the present invention to overcome the above noted drawbacks associated with presently known prior art scope mounting systems.

Another object of the present invention is to provide a scope mounting system which prevents relative axially sliding movement of scope ring assemblies, supporting the scope, relative to scope bases, secured to the firearm, upon discharge of the firearm.

Still another object of the invention is to provide a mating recess in the scope ring assembly which mates with a recoil stop provided on a mating scope base to prevent relative movement between those components.

Yet, another object of the invention is to provide dust covers for each of the scope bases, for use when the scope and the scope ring assemblies are removed from the firearm, to prevent the dovetails provided on the scope bases from being inadvertently damaged.

A still further object of the invention is to provide a peep sight which will be quickly and securely attached to one of the scope bases once the scope and the scope ring assemblies are removed from the firearm.

Yet another object of the invention is to facilitate quick, easy and accurate realignment of a previously sighted and removed scope when it is again attached to the firearm.

The present invention relates to a scope mounting system for mounting a scope to a firearm, said scope mounting system comprising: at least one scope base having a male dovetail protrusion formed in a first surface thereof and having a mechanism for releasably attaching said at least one scope base to a barrel of the firearm; and at least one scope ring assembly having a clamping mechanism for clamping a desired scope to said at least one scope ring assembly and a female dovetail slot for securing said at least one scope ring assembly to said at least one scope base by engagement of said female dovetail slot with said mating male dovetail protrusion; wherein said at least one scope base is provided with a recoil stop to prevent relative axial movement, in at least one direction, between said at least one scope ring assembly and said mated scope base when the scope is mounted to the firearm, via said at least one scope ring assembly and said at least one scope base, and the firearm is discharged.

The present invention also relates to a method of mounting a scope to a firearm in order to automatically zero the scope after each discharge of the firearm, said method comprising the steps of: a) securing at least one scope base to a barrel of a firearm, said at least one scope base having a male dovetail protrusion; b) clamping a scope to at least one scope ring assembly, via a clamp mechanism supported by said scope ring assembly, and said scope ring assembly having a female dovetail slot formed therein; c) engaging said at least one scope ring assembly with said at least one scope base via engagement between said female dovetail slot and said male dovetail protrusion; and d) forming a recoil stop in said at least one scope base to prevent axial movement between said at least one scope base and said at least one scope ring assembly when the scope is mounted to the firearm, via said at least one scope ring assembly and said at least one scope base, and the firearm is discharged.

Finally, the present invention relates to a firearm having a scope mounting system for mounting a scope to said firearm, said firearm comprising: a barrel having a firing mechanism operatively connected to a breech end of the barrel for discharging the firearm as desired, and a stock portion supporting said barrel and said firing mechanism; and said scope mounting system comprising: at least one scope base having a male dovetail protrusion formed in a first surface thereof, and said at least one scope base being releasably attached said barrel via an attachment mechanism; and at least one scope ring assembly having a clamping mechanism for clamping a desired scope to said at least one scope ring assembly and a female dovetail slot securing said at least one scope ring assembly to said at least one scope base by engagement of said female dovetail slot with said male dovetail protrusion; wherein said at least one scope base is provided with a recoil stop to prevent relative axial movement, in at least one direction, between said scope ring assembly and said scope base when the scope is mounted to the firearm, via said scope ring assemblies and said scope bases, and the firearm is discharged.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
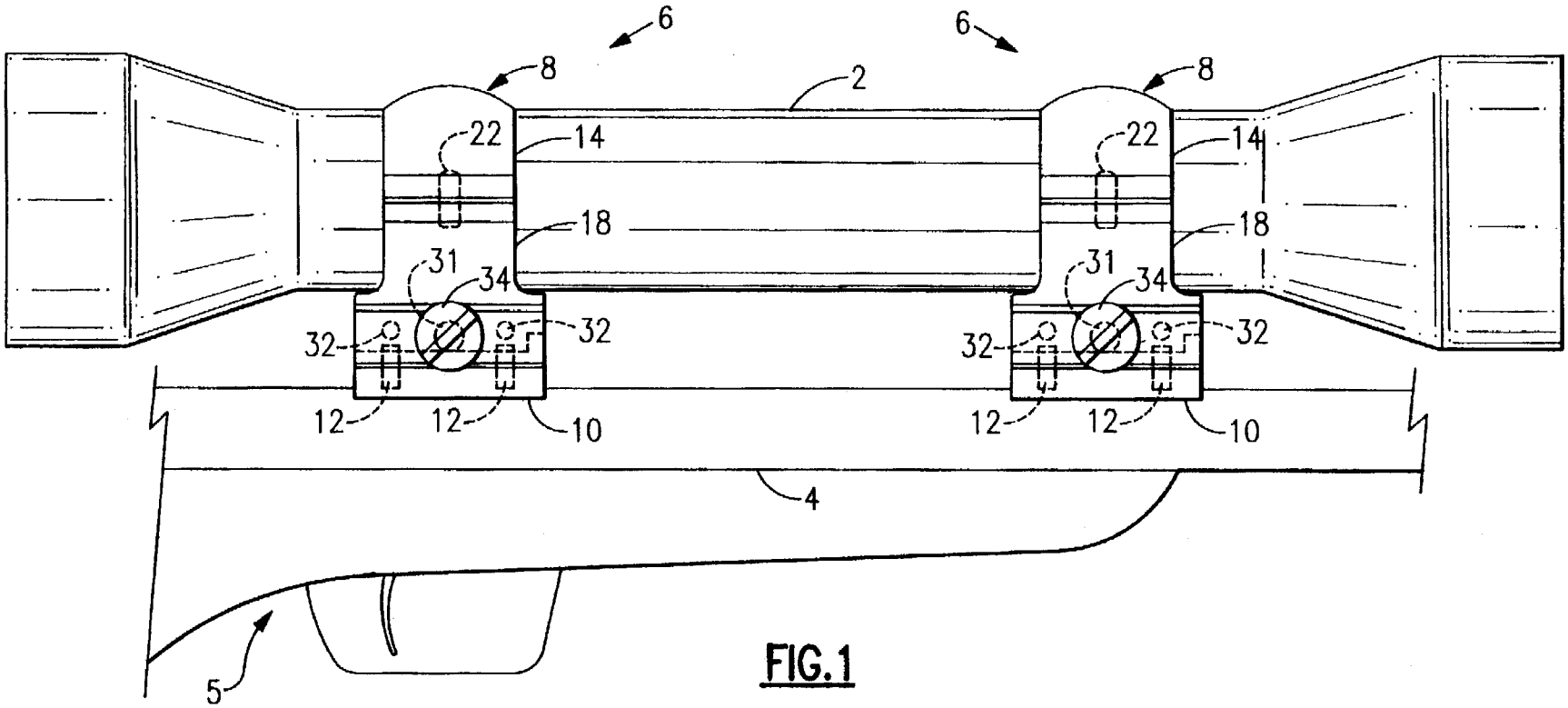
FIG. 1 is a diagrammatic side elevational view of the scope mounting system of the present invention shown with a scope attached thereto and secured to the barrel of a firearm.

Turning now to FIG. 1, a detailed description concerning the present invention will now be provided. A scope 2 is shown mounted to barrel 4 of a firearm 5 (only partially shown) via scope mounting system 6. Firearm 5 has a stock portion and a firing mechanism which are well known in this art and are only partially shown. Scope mounting system 6 comprises a pair of scope ring assemblies 8 each secured to a scope base 10. Scope bases 10 are each secured to a top surface of barrel 4 via a pair of set screws 12.

Figure 2:
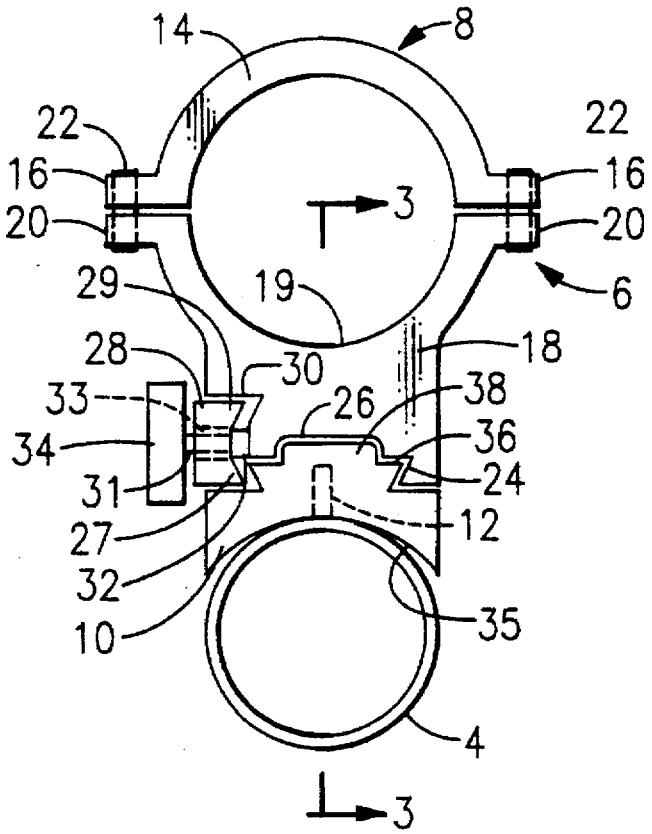
FIG. 2 is a diagrammatic end view of the scope mounting system of FIG. 1, with the scope removed for clarity, shown attached to the barrel of a firearm.

Turning now to FIG. 2, a more detailed discussion of scope mounting system 6 will now be provided. The upper portion of scope ring assembly 8 includes clamp 14 having a generally semi-circular shape to accommodate a top portion of scope 2, with a pair of opposed clamp flanges 16 extending outwardly from each end of clamp 14. Each clamp flange 16 is provided with a through hole for receiving a screw or another similar fastener. A lower portion of scope ring assembly 8 comprises ring base 18 having a semi-circular recess 19 in a top portion thereof to accommodate a lower portion of scope 2, and a pair of opposed base flanges 20 extending outwardly therefrom to receive and mate with clamp flanges 16. Each base flange 20 is provided with a threaded bore which is aligned with the through bore of the clamp flanges 16 when the clamp 14 is mated with the ring base 18. Clamp 14 is secured to ring base 18 about scope 2 (as seen in FIG. 1) via a pair of fasteners 22 inserted through the holes in clamp flanges 16 and threaded into the threaded bores in base flanges 20. Fasteners 22 are typically allen head type set screws, but may be any fastener which securely fastens the mating flanges 16, 20 together around scope 2. It is to be appreciated that a variety of other known clamping mechanisms, which are well known in this art, may be used in lieu of the above disclosed clamp 14 and ring base 18 arrangement, without departing from the spirit and scope of the present invention. It is to be appreciated that the clamping force provided by clamp 14 and semi-circular recess 19 must be sufficient to maintain the scope in a desired secured position even upon discharging the firearm to prevent relative movement between the scope and the scope ring assemblies.

Ring base 18 has a female dovetail slot 24 formed in a lower portion thereof. A recess 26 is formed in one (front) surface of ring base 18. A lower portion 27 of a cup shaped clamp member 28 removably forms one side wall of dovetail slot 24 while upper portion 29 of clamp member 28 mates with notch 30, formed in a side portion of ring base 18. A threaded post 31 projects outwardly from ring base 18 and extends through bore 33 provided in clamp member 28. A pair of springs 32 are disposed between clamp member 28 and ring base 18, on opposed sides of post 31, for biasing clamp member 28 away from ring base 18. Threaded knob 34, having an internal threaded bore, threadingly engages with post 31 to force clamp member 28 toward ring base 18.

Semi-circular groove 35 is formed in a lower portion of scope base 10 to allow the scope base to closely mate and accommodate a top portion of barrel 4. Male dovetail projection 36 is formed in an upper portion of scope base 10 which matingly engages with female dovetail slot 24. As threaded knob 34 is tightened, clamp member 28 is biased axially along post 31 so that upper portion 29 secures clamp member 28 to ring base 18 via notch 30, and lower portion 27, forming a side wall of female dovetail slot 26, secures clamp member 28 to the male dovetail projection 36 of scope base 10.

Recoil stop 38 projects upwardly from a front end of dovetail projection 36 and mates with mating recess 26 provided in ring base 18. A zero position for scope 2 is created where recess 26 is engaged with and abuts against recoil stop 38 and the male dovetail projection 36 is received by the female dovetail slot 24 and securely attached thereto via the clamping action of clamp member 28 being tightened by threaded knob 34.

Once the scope 2 is mounted to the firearm 5 via a pair of ring bases 18 mating with the scope bases 10 with recess 26 abutting against recoil stop 38, the scope 2 is secured in a locked, zeroed position. An individual can then adjust the sighting of the scope 2, at this zeroed position, so that repeated accurate firing of the firearm 5 is achievable. As such sighting of the scope is conventional and well known in the art, a further detailed discussion concerning the same is not provided.

Figure 3:
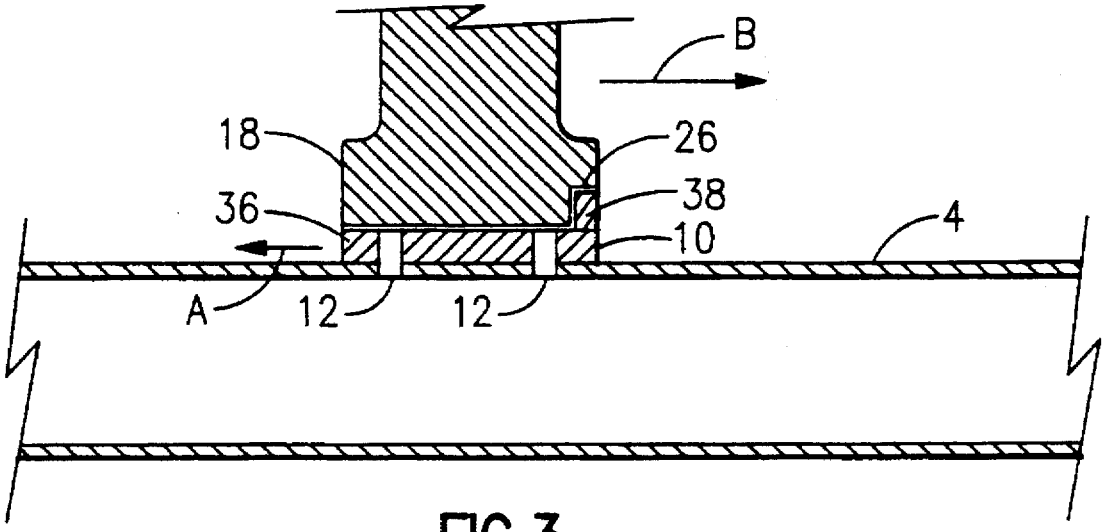
FIG. 3 is a partial sectional view of the scope mounting system taken along section line 3—3 of FIG. 2.

Turning now to FIG. 3, the importance of recess 26 and recoil stop 38 will be discussed. Upon discharging the firearm 5, scope base 10, which is securely fastened to the barrel 4, tends to recoil with the barrel 4 (in the direction of the arrow A as can be seen in FIG. 3) as a result of the discharge of the firearm 5 while the slug is fired in the opposite direction (in the direction of the arrow B as can be seen in FIG. 3) as the gun powder is ignited. Ring base 18 tends to remain stationary but, due to the recoil force of scope base 10 and barrel 4, has a resulting force tending to move or slide the ring base 18 axially toward the muzzle end of the barrel relative to the scope base 10 and barrel 4 in the direction of the arrow B. As recoil stop 38, formed on scope base 10, is already engaged with recess 26, formed on ring base 18, this engagement prevents the components from moving in opposed directions and maintains the original zeroed position of the scope 2. Further, each discharge of the firearm 5 tends to realign the scope mounting system 6 back to its original zeroed position and assists with maintaining those two members at their zeroed position, thereby obviating the need to readjust the sighting of the firearm 5 after repeated firing.

It is to be appreciated that ring base 18 need not be provided with recess 26. Scope base 10 could extend beyond ring base 18 such that recoil stop 38 would contact an end face of ring base 18 to provide the desired cooperation between those two components and prevent relative movement between the same.

Figure 4:
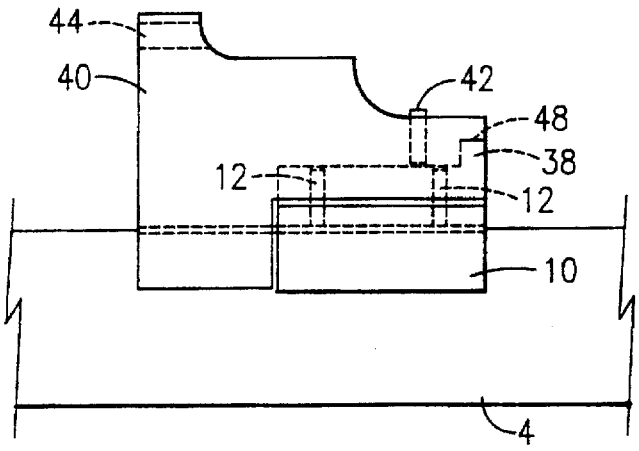
FIG. 4 is a diagrammatic elevation of one of the scope bases of FIG. 1 secured to the barrel of a firearm with a peep sight attached thereto.
Figure 5:
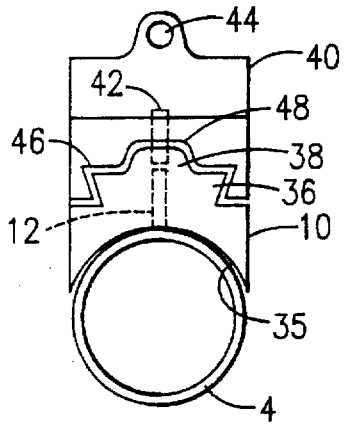
FIG. 5 is a diagrammatic end view of a peep sight shown attached to the scope base of FIG. 4.

Turning now to FIGS. 4 and 5, peep sight 40, for use when scope 2 is not attached to the firearm 5, is shown secured to scope base 10 in a similar manner as scope 2. Peep sight 40 is also provided with a female dovetail slot 46 which is formed in a lower portion of peep sight 40 and sized to closely mate with and accommodate male dovetail projection 36 of scope base 10. Sighthole 44 is formed in an upper portion of peep sight 40 for targeting the firing direction of the firearm 5. Recess 48 is formed in a leading or forward end of peep sight 40 to mate with recoil stop 38. A threaded through bore extends longitudinally through a top surface of peep sight 40 and accommodates a securing mechanism 42, such as a set screw, for securing peep sight 40 to scope base 10 at a desired location, i.e. recess 48 abutting against recoil stop 38. Peep sight 40 is secured to the scope base 10 in a manner such that recess 48 engages and abuts against recoil stop 38 to secure the peep sight 40 at its forward most zeroed position. When the firearm 5 is discharged, recess 48 and recoil stop 38 cooperate with one another, in the same manner described above with respect to FIG. 3, to prevent those two components from moving in opposed directions and maintain the original zeroed position of peep sight 40 relative to scope base 10.

Peep sight 40 is provided with a conventional adjustment mechanism which allows up and down as well as left and right adjustment of sighthole 44 relative to the barrel 4. As such adjustment mechanisms for peep sights are well known in art, it is not shown in any detail in the drawings and a further detailed description concerning the same is not provided. It will be appreciated, however, that virtually any known conventional adjustment mechanism for a manual peep sight, which allows up and down as well as left and right adjustment of sighthole 44 relative to the barrel 4, and incorporating the recoil stop feature of the present invention, may be employed.

Figure 6:
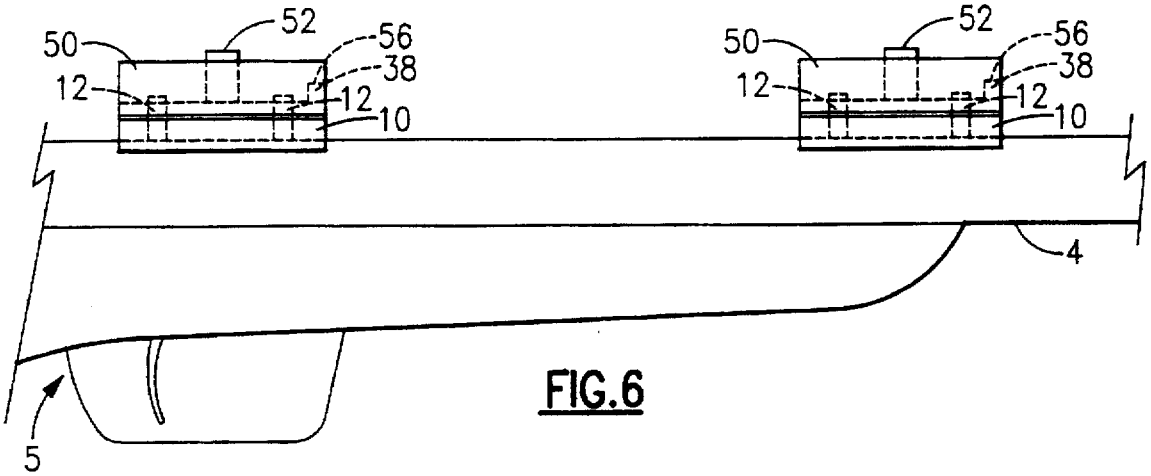
FIG. 6 is a diagrammatic elevation of the scope bases of FIG. 1 shown secured to the barrel of a firearm with dust covers attached thereto.
Figure 7:
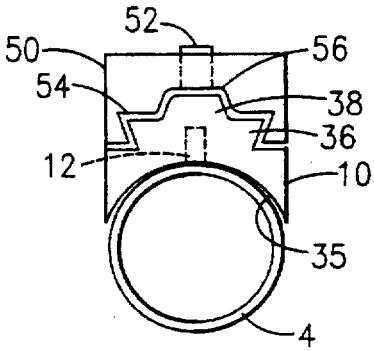
FIG. 7 is a diagrammatic end view of one of the dust covers and scope bases of FIG. 6.

Turning now to FIGS. 6 and 7, dust covers 50, for use when neither scope 2 nor peep sight 40 is attached to the firearm 5, may be utilized in order to protect scope bases 10 from inadvertent damage. Dust cover 50 has female dovetail slot 54 formed in a lower portion thereof for closely receiving and mating projection dovetail projection 36 of scope base 10. Dust covers 50 are secured to scope bases 10 via one or more set screws 52. A recess 56 is formed in a front end surface of dust cover 50 to mate with recoil stop 38. When the dust covers 50 are secured to the scope bases 10, they prevent any damage from occurring to the recoil stop 38 and/or the male dovetail projection 36.

While the present invention has been disclosed as relating to a female and male dovetail arrangement, it is to be appreciated that a variety of other mating arrangements are also possible and are considered with the spirit and scope of the present invention. Secondly, it is also contemplated that the scope may be mounted to the firearm via a single elongate scope base which releaseably mates with a single elongate scope ring assembly, instead of the pair of scope bases and scope ring assemblies shown in the drawings and discussed above.

Since certain changes may be made in the above described, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I claim:

1. A scope mounting system for mounting a scope to a firearm, said scope mounting system comprising:

at least one scope base having a male dovetail protrusion formed in a first surface thereof and having a mechanism for releasably attaching said at least one scope base to a barrel of the firearm; and at least one scope ring assembly having a clamping mechanism for clamping a desired scope to said at least one scope ring assembly and a female dovetail slot for securing said at least one scope ring assembly to said at least one scope base by engagement of said female dovetail slot with said mating male dovetail protrusion;

wherein said at least one scope base is provided with a recoil stop to prevent relative axial movement, in at least one direction, between said at least one scope ring assembly and said at least one scope base when the scope is mounted to the firearm, via said at least one scope ring assembly and said at least one scope base, and the firearm is discharged; and said scope mounting system further comprising a removable dust cover which has a female dovetail slot and a securing mechanism for releasably securing said dust cover to said at least one scope base when said scope is not in use.

2. A scope mounting system according to claim 1, wherein said dust cover has a recess formed in an end surface thereof to mate with said recoil stop of said at least one scope base.

3. A scope mounting system for mounting a scope to a firearm, said scope mounting system comprising:

a pair of separate scope bases, each said separate scope base having a male dovetail protrusion formed in a first surface thereof and a mechanism for releasably attaching said scope base to a barrel; and a pair of separate scope ring assemblies, each said separate scope ring assembly having a clamping mechanism for clamping a desired scope to said scope ring assembly and a female dovetail slot for securing each said scope ring assembly to one of said pair of scope bases by engagement of said female dovetail slot with one of said mating male dovetail protrusions;

wherein both of said scope bases are similar in shape and appearance to one another and are each provided with a recoil stop located remote from the breech end of the barrel to prevent relative axial movement, in one direction, between each said scope ring assembly and said scope base supporting said scope ring assembly, when a scope is mounted to a firearm via said pair of scope ring assemblies and said pair of scope bases and the firearm is discharged, and a barrel engaging surface of each of said scope bases is matable with the barrel and lacks any protrusion integrally formed with each said scope base and extending away from the barrel engaging surface toward the barrel for engagement with the barrel.

4. A scope mounting system according to claim 3, wherein a recess is formed in an end surface of each of said scope ring assemblies to mate with said recoil stop provided in said scope base.

5. A scope mounting system according to claim 4, further comprising a peep sight, which comprises a sight, a female dovetail slot and a securing mechanism for locking said peep sight to one of said scope bases when said scope is removed from the firearm and said female dovetail of said peep sight is received by said male dovetail protrusion of one of said scope bases.

6. A scope mounting system according to claim 5, wherein said peep sight has a recess formed in an end surface thereof to mate with said recoil stop when said peep sight is engaged with one of said scope bases.

7. A scope mounting system according to claim 3, further comprising a dust cover which has a female dovetail slot and a securing mechanism for securing said dust cover to one of said scope bases when said scope is removed from the firearm and said female dovetail slot of said dust cover is received by said male dovetail protrusion of one of said scope bases.

8. A scope mounting system according to claim 7, wherein said dust cover has a recess formed in an end surface thereof to mate with said recoil stop.

9. A scope mounting system according to claim 3, wherein said female dovetail slot comprises:

a notch formed in a lower portion of said scope ring assembly;

a substantially C-shaped clamp member secured to said scope ring assembly, an upper portion of said C-shaped clamp member engaging with said notch and a lower portion of said clamp member forming a side wall of said female dovetail recess for removably securing said female dovetail slot with said male dovetail protrusion; and a biasing member for biasing said C-shaped clamp member into clamping engagement with said male dovetail protrusion and for releasing said C-shaped clamp member from engagement with said male dovetail protrusion.

10. A method of mounting a scope to a firearm in order to automatically zero the scope after each discharge of the firearm, said method comprising the steps of:

a) clamping a scope to a pair of separate spaced apart scope ring assemblies, via a clamp mechanism supported by each of said scope ring assemblies, and providing each of said scope ring assemblies with a female dovetail slot;

b) placing a pair of separate scope bases, in a spaced apart relationship, to a top surface of a barrel of a firearm adjacent a muzzle end of the barrel, each of said pair of scope bases having a male dovetail protrusion in a top surface thereof;

c) forming a recoil stop on each of said scope bases to prevent axial movement between said scope bases and said scope ring assemblies, once the scope is mounted to the firearm via said scope ring assemblies and said scope bases and the firearm is discharged;

d) securing said each of said scope bases to a muzzle end of the barrel such that said recoil stop of each of said scope bases is locate remote from the muzzle end of the barrel so that one of said scope ring assemblies may be located between said recoil stop and the muzzle end of the barrel;

e) engaging each of said scope ring assemblies with one of said pair of scope bases via engagement between said female dovetail slot and said male dovetail protrusion; and f) abutting a front surfaces of each of said scope ring assemblies against said recoil stop of each of said scope bases to prevent axial movement of said scope ring assemblies in a direction away from said muzzle end of the barrel upon discharge of the firearm and fastening said scope ring assemblies in the abutting position.

11. A method according to claim 10, further comprising the steps of:

forming a recess in one end surface of at least one of said scope ring assemblies; and receiving said recoil stop formed in said scope base within said recess to prevent axial movement of said scope ring assemblies in a direction away from said muzzle end of the barrel upon discharging the firearm.

12. A method according to claim 10, further comprising the steps of removing said pair of ring assemblies supporting said scope, and securing a peep sight with a sight, having a female dovetail slot formed in a lower portion thereof, to one of said scope bases;

forming a recess in one end surface of said peep sight to mate with said recoil stop formed in one of said scope bases; and locking said peep sight to said scope base.

13. A method according to claim 10, further comprising the steps of removing said pair of scope ring assemblies supporting said scope, and securing a dust cover, having a female dovetail slot formed in a lower portion thereof, to at least one of said scope bases;

forming a recess in one end surface of said dust cover to mate with said recoil stop formed in one of said scope bases; and locking said dust cover to said scope base.

14. A firearm having a scope mounting system for mounting a scope to said firearm, said firearm comprising:

a barrel having a firing mechanism operatively connected to a breech end of the barrel for discharging the firearm as desired, and a stock portion supporting said barrel and said firing mechanism; and said scope mounting system comprising:

a pair of separate scope bases, each said separate scope base having a male dovetail protrusion formed in a first surface thereof and a mechanism for releasably attaching said scope base to a barrel; and a pair of separate scope ring assemblies, each said separate scope ring assembly having a clamping mechanism for clamping a desired scope to said scope ring assembly and a female dovetail slot for securing each said scope ring assembly to one of said pair of scope bases by engagement of said female dovetail slot with one of said male dovetail protrusions;

wherein both of said scope bases are similar in shape and appearance to one another and are each provided with a recoil stop located remote from the breech end of the barrel to prevent relative axial movement, in one direction, between each said scope ring assembly and said scope base supporting said scope ring assembly, when a scope is mounted to a firearm via said pair of scope ring assemblies and said pair of scope bases and the firearm is discharged, and a barrel engaging surface of each of said scope bases mates with the barrel and lacks any protrusion, integrally formed with each said scope base and extending away from the barrel engaging surface toward the barrel for engagement with the barrel.

15. A firearm according to claim 13, further comprising a recess formed in an end surface of at least one of said scope ring assemblies to mate with said recoil stop formed said scope base.

16. A firearm according to claim 14, further comprising a peep sight which comprises a sight, a female dovetail slot and a securing mechanism for locking said peep sight to one of said scope bases when said scope is removed from the firearm and said female dovetail of said peep sight is received by said male dovetail protrusion of one of said scope bases.

17. A firearm according to claim 16, wherein said peep sight has a recess formed in an end surface thereof to mate with said recoil stop formed in one of said scope bases when said peep sight is engaged therewith.

18. A firearm according to claim 14, wherein said firearm further comprises at least one dust cover with a female dovetail slot formed therein and a securing mechanism for securing said dust cover to one of said scope bases when said scope is removed from the firearm and said female dovetail slot of said dust cover is received by said male dovetail protrusion of one of said scope bases.

19. A firearm according to claim 18, wherein said at least one dust cover has a recess formed in an end surface thereof to mate with said recoil stop formed in said at least one scope base.

20. A firearm according to claim 14, wherein said female dovetail slot comprises:

a notch formed in a lower portion of said scope ring assembly;

a substantially C-shaped clamp member secured to said scope ring assembly, an upper portion of said C-shaped clamp member engaging with said notch and a lower portion of said clamp member forms a side wall of said female dovetail recess for removably securing said female dovetail slot with said male dovetail protrusion; and a biasing member for biasing said C-shaped clamp member into clamping engagement with said male dovetail protrusion and for releasing said C-shaped clamp member from engagement with said male dovetail protrusion, as desired.

* * * * *